United States Patent [19]

Baugh

[11] Patent Number: 4,825,954

[45] Date of Patent: May 2, 1989

[54] LINER HANGER WITH IMPROVED BITE AND METHOD

[75] Inventor: J. L. Baugh, Houston, Tex.

[73] Assignee: Baker Hughes Incorporated, Houston, Tex.

[21] Appl. No.: 155,566

[22] Filed: Feb. 12, 1988

[51] Int. Cl.[4] ..... E21B 23/00

[52] U.S. Cl. ..... 166/382; 166/208; 166/216; 166/217

[58] Field of Search ..... 166/381, 382, 85, 206, 166/208, 209, 216, 217

[56] References Cited

U.S. PATENT DOCUMENTS

| | | | |
|---|---|---|---|
| 4,582,134 | 4/1986 | Gano et al. | 166/217 |
| 4,641,708 | 2/1987 | Wightman | 166/217 |
| 4,681,166 | 7/1987 | Cuiper | 166/217 |
| 4,690,220 | 9/1987 | Braddick | 166/382 |
| 4,711,326 | 12/1987 | Baugh et al. | 166/217 |
| 4,732,212 | 3/1988 | Fraser, III | 166/216 |
| 4,750,563 | 6/1988 | Baugh | 166/382 |
| 4,762,177 | 8/1988 | Smith, Jr. | 166/216 |

*Primary Examiner*—Jerome W. Massie
*Assistant Examiner*—Terry Lee Melius
*Attorney, Agent, or Firm*—Hubbard, Thurman, Turner & Tucker

[57] ABSTRACT

An improved liner hanger is provided suitable for use with conventional slips to interconnect a downhole casing with a smaller-diameter liner. The hanger comprises an outer cone sleeve and an inner locking sleeve, with the cone sleeve interconnected with the conventional slips, and the locking sleeve having right-hand and left-hand inner biting threads for engagement with the outer surface of a tubular liner section. Improved mating threads are provided on the outer surface of the locking sleeve and the inner surface of the cone sleeve. The cone sleeve and locking sleeve are initially made up at the surface with the apexes of the tapered thread profiles substantially in axial alignment. After the liner hanger is initially positioned downhole, an axially directed downward force on the locking sleeve causes the locking sleeve to slide along the tapered surface of its thread profile with respect to a corresponding tapered surface on the thread profile of the cone sleeve, thereby shifting the apexes out of alignment and moving the biting threads radially inward for increased gripping engagement with the tubular liner section. Stop surfaces on both the locking sleeve and the cone sleeve limit axial movement of the locking sleeve with respect to the cone sleeve and thus prevent excessive radial force, which could otherwise cause failure of the liner hanger components or crush the liner.

19 Claims, 2 Drawing Sheets

LINER HANGER WITH IMPROVED BITE AND METHOD

FIELD OF THE INVENTION

The present invention relates to tubing or casing anchors used in the petroleum recovery industry and, more particularly, to tubing anchors of the type utilized to hang liners from downhole casing and having mating threads between a cone sleeve and a locking sleeve.

BACKGROUND OF THE INVENTION

Liner hangers have long been used in oil and gas recovery operations for suspending or hanging a liner from a well casing. As used herein, the term "liner" means a section of tubing, casing, or similar tubular material to be secured to a larger-diameter downhole tubular generally fixed within the well bore. Included in this definition is a "tieback liner", which is a section of tuving extending upward within the well casing from the hanger, and a "scab liner", which is typically used to repair damaged casing.

A liner normally does not extend to the surface, and is a simple yet highly versatile tubular generally utilized as a cost effective solution to various anticipated or unanticipated downhole problems. Liners may be utilized, for example, to prevent loss of circulation in weak upper zones while drilling with weighted mud to control deeper pressurized zone. Scab liners are frequently used to repair corroded or damaged casing either above or below the liner hanger to allow for continued cost-effective production operations. Liners may also be used to economically conduct cased hole tests of questionable zones, since liners may be "run in" a well much faster than full diameter casing, thereby reducing "trip" time and rig expense. Liners often extend down past the well casing several hundred feet or more into "open hole", and may either be cemented in place or remain supported, solely by the liner hanger.

Mechanically or hydraulically set slips are typically used to effectively interconnect the liner hanger to the casing, and various techniques have been devised for securing a liner to the liner hanger. A fixed interconnection of the liner and the liner hanger is often more difficult to obtain than the casing/liner hanger interconnection, however, and accordingly many prior art liner hangers are intended to cooperate with specially prepared liners. In some instances field welding is used to interconnect the liner with liner hanger components. Other liner hangers require the liners to be threaded with special or "premium" threads, thereby increasing costs and reducing versatility of the liner.

Certain types of liner hangers, such as the Brown Flex Lock liner hanger, does not require special preparation of the liner. These hangers utilize an outer cone sleeve and an inner split-ring locking sleeve with mating threads. Right-hand and left-hand interior threads on the inner locking sleeve bite into the outer surface of the liner as the cone sleeve and a jamb nut are threaded together, thereby causing the locking sleeve to bite the liner. This type of liner hanger allows a customer's standard liner or pipe to be suspended from a casing without modification. The desired axial position of the liner with respect to the hanger can thus be readily adjusted at the well site, and thus this type of Brown liner hanger is accordingly preferred by some customers.

The above described Brown liner hangers are, however, frequently not employed when utilizing hard grades of liners. The "teeth" forming the right-hand and left-hand threads on the inner surface of the locking sleeve are designed to bite into the liner as the outer cone sleeve and a jamb nut are torqued together, but the desired bite has heretofore been difficult to obtain in hard grades of steel liners. Since inadvertent downhole separation of the liner and liner hanger must be avoided to prevent an expensive workover operation, customers often require the more expensive and less versatile liners and hangers when utilizing hard grades of liners.

Threads having a straight buttress thread profile have been provided for mating engagement between the cone sleeve and the inner locking sleeve of the above described Brown liner hangers. While at the surface, the torqued engagement of the cone sleeve and the jamb nut thus provides an axial force which causes the threads on the locking sleeve to slide along the corresponding taper of the thread profile on the cone sleeve, thereby driving the inner teeth on the locking sleeve to bite the liner. When utilizing harder grades of liners, operators may question whether the desired tooth penetration of the locking sleeve to the liner will be obtained to prevent slippage of the liner along the liner hanger as it is lowered into the well. Accordingly, use of the above-described Brown liner hangers has been limited.

If an axially directed load is applied to the Flex Lock liner after it is positioned in the well, a slight additional axial movement between the cone sleeve and the locking sleeve may occur as the locking sleeve continues to slide along the thread profile of the cone sleeve thereby driving the teeth of the locking sleeve into deeper engagement with the liner. This motion is, however, unrestricted since the radial biting force applied by the locking sleeve to the liner may continually increase with an increase in the axial load. Moreover, this continued sliding motion along the taper of the thread profiles results in less threaded engagement between the cone sleeve and the locking sleeve, thereby increasing stress on those components, which may cause failure. Finally, this motion may cause the tapered surfaces of threads on the cone sleeve and locking sleeve to pass completely past each other or "jump" to the next thread, which will then likely continue in rapid fashion until the locking sleeve and cone sleeve separate or fail due to increased stress, again resulting in an expensive workover operation.

The disadvantages of the prior art are overcome by the present invention, and improved methods and apparatus are hereinafter disclosed for interconnecting a downhole casing with a liner.

SUMMARY OF THE INVENTION

The liner hanger of the present invention comprises an outer cone sleeve and an inner locking sleeve, with the locking sleeve including right-hand and left-hand threads on its inner surface for biting engagement with the liner. Improved mating threads are provided on the outer surface of the locking sleeve and the inner surface of the cone sleeve to impart an increased radial force to the liner due to the combination of torqued engagement between the locking sleeve and the cone sleeve, coupled with axial movement of the locking sleeve relative to the cone sleeve upon the application of a significant axial force to the downhole liner section being gripped by the locking sleeve.

Mating threads on the cone sleeve and locking sleeve are each provided with a thread profile having oppositely tapered surfaces. Axial movement of a locking sleeve relative to the cone sleeve in either direction thus forces th locking sleeve radially inward as it moves along an adjoining tapered surface of the cone sleeve, thereby increasing the biting force of the locking sleeve on the liner. The taper of adjoining surfaces for the cone sleeve/locking sleeve threads is between 12° to 28° from the vertical axis, and preferably from about 16° to 24°. Stop surfaces on both the cone sleeve and locking sleeve engage to limit axial movement, thereby maintaining the increased radial forces below a preselected limit.

According to the technique of the present invention, the locking sleeve and cone sleeve are initially made up and torqued together at the surface, thereby creating an initial biting force to secure the locking sleeve to the liner. The liner and hanger are then lowered to their desired position in the well, and the liner hanger is secured to the casing utilizing conventional slips. At this stage, the apexes of the thread profiles on the cone sleeve and the locking sleeve will be substantially aligned in the axial direction.

The desired increased biting force imparted to the liner results from the subsequent application of an axially directed force to the liner, which causes the thread profile apexes to move axially out of alignment as the biting force increases. This application of an axially directed force may occur when the weight of the liner and interconnected downhole components are released to the liner hanger, or may occur as the liner and hanger are being retrieved to the surface. Stop surfaces preferably formed as a portion of the thread profile on the locking sleeve and cone sleeve limit axial movement between these components when an extremely high axial force is applied to the liner, and thus prevent failure of liner hanger components or collapse of the liner.

These and further features and advantages of the present invention will become apparent from the following detailed description, wherein reference is made to the figures in the accompanying drawings.

DETAILED DESCRIPTION OF PREFERRED EMBODIMENTS

Figure 1:
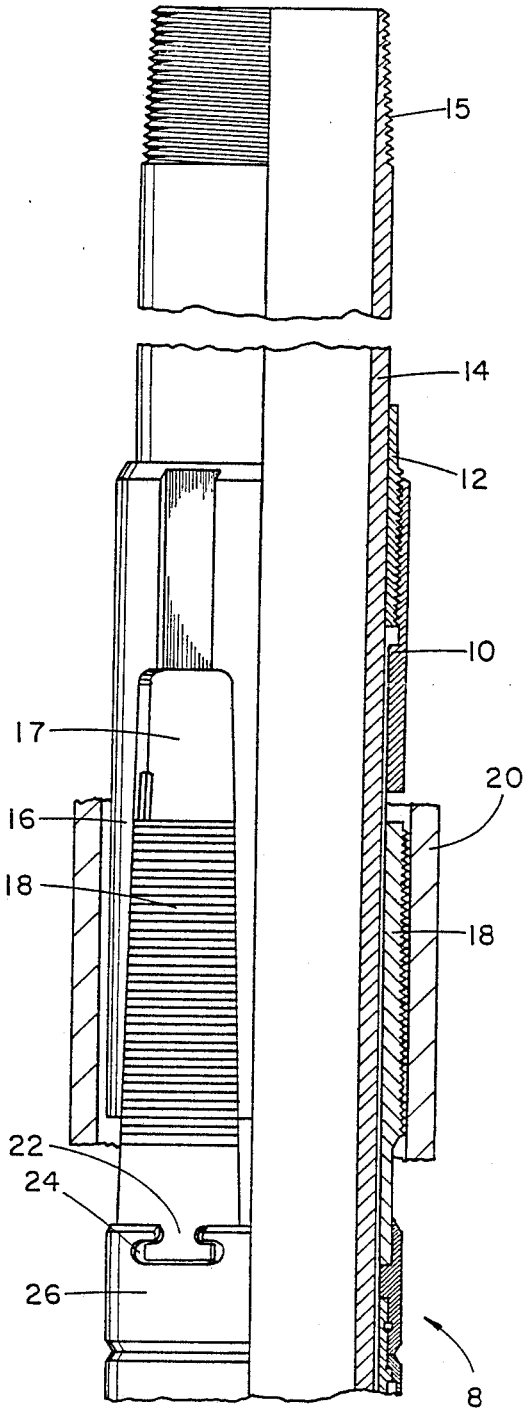
FIGS. 1 and 1A is a half sectional view of a liner hanger according to the present invention.
Figure 1A:
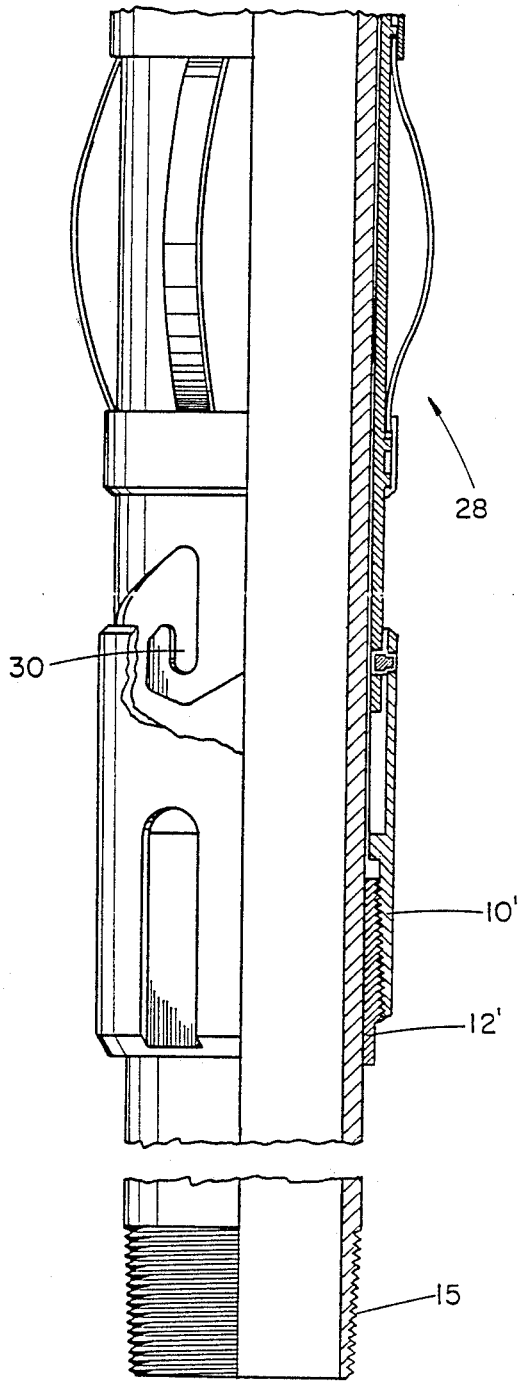

Referring to FIG. 1, a suitable embodiment of a liner hanger 8 of the present invention includes an upper cone sleeve 10, and an upper inwardly-positioned locking sleeve 12 which secures the liner section 14 thereto as explained subsequently. A second lower cone sleeve 10' and a locking sleeve 12' are shown at the lower end of the liner hanger, with these components being identical to those described above but positioned in a mirror image arrangement. It can be seen from FIG. 1 that the liner section 14 is not modified in any manner, and accordingly the axial position of the liner with respect to the hanger 8 can be readily changed.

Three circumferentially spaced downwardly projecting legs 16 affixed to the cone sleeve define respective slip seat pockets 17, into which fit slips 18 in conventional fashion. The slips 18 are circumferentially locked to the cone sleeve 10, and an interlocking tongue and groove arrangement between sides of the slips and the legs allows for axial movement of the slips with respect to the legs 16 along the tongue and groove taper. Axial movement of the slips along the taper brings the threads of the slips into fixed engagement with the well casing 20 in a conventional manner.

Each of the slips 18 may be provided with a projection 22 for fitting engagement in slot 24 in the ring portion 26 of the bow spring or drag block assembly 28, thereby interconnecting the slips to the bow spring assembly. The lower cone sleeve 10' and locking sleeve 12' are similarly interconnected to the bow spring assembly 28 by a conventional J-slot arrangement 30. Either one or two cone sleeves and respective locking sleeves may thus be utilized to secure the liner to the casing.

Those skilled in the art recognize that the liner hanger assembly shown in FIG. 1 is generally representative of conventional liner hanger assemblies, with the exception of the cone sleeve and locking sleeve described subsequently. Tubular lengths of liner are conventionally threaded onto the upper or lower threads of the liner section 14, and various types of "setting tools" may be employed to position the assembly as shown in FIG. 1 at its selected depth in the well bore. Once positioned, frictional engagement of the drag blade assembly 28 with the casing 20 allows the operator to "pick up" on the liner, rotate the liner to the right or left to disengage the J-slot assembly, then "set down" to move the slips 18 downward with respect to legs 16 until the slips move radially outward into biting and secured engagement with the casing 20.

Figure 2:
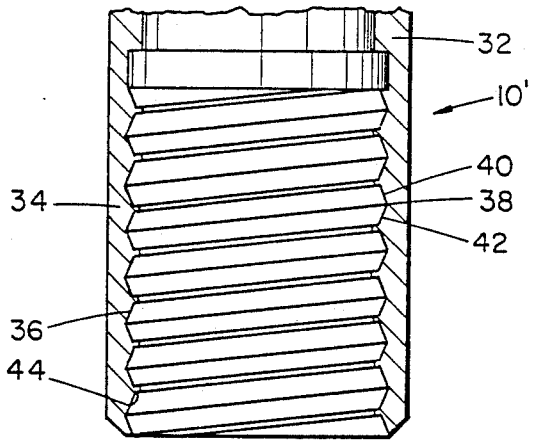
FIG. 2 is a sectional view of the lower cone sleeve shown in FIG. 1.
Figure 4:
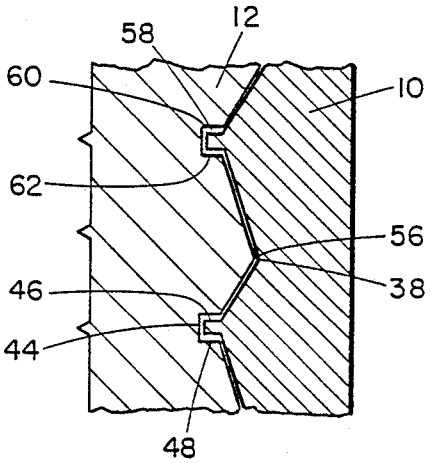
FIG. 4 is a pictorial view of a thread profile for the locking sleeve with respect to a thread profile for the cone sleeve when the liner hanger is run into the well.

Referring now to FIG. 2, the lower cone sleeve 10' is shown in greater detail to include a body portion 32 with threaded end 34 having tapered thread 36 along an inner surface thereof. Each of the threads 36 may be provided at a spacing of two threads per inch, with each thread profile having an apex 38 formed by the intersection of the adjoining planar and oppositely tapered surfaces 40 and 42, each cut at a preferably identical angle of, e.g., 20° from the vertical. Each of the threads 36 therefore has a thread profile which includes tapered surfaces 40,42 forming an exterior angle outside the cone sleeve of 140°. At the end of each of the surfaces 40,42 opposite the apex is a projection 44, having an upper and a lower stop surface 46,48 (see FIG. 4), each preferably perpendicular to the central axis of the liner. As shown in FIGS. 2 and 4, the projection 44 with planar stop surfaces 46,48 is thus a part of the thread profile for the entire length of thread 36, and thus it should be understood that the projection 44 is a spiraling projection spaced between the spiraling apex 38 of thread 36.

Figure 3:
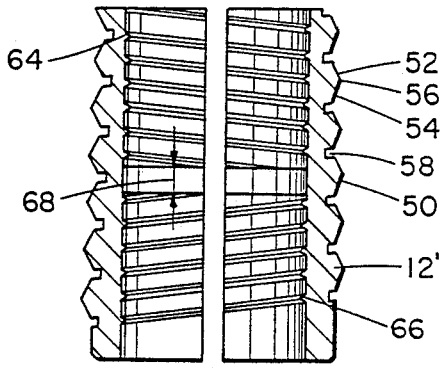
FIG. 3 is a sectional view of the lower locking sleeve shown in FIG. 1.

Referring to FIG. 3, sleeve 12' includes similar threads 50 on the outer surface thereof, also spaced at two threads per inch for mating engagement with threads 36. The threads 50 have a thread profile which include tapered surfaces 52,54 which meet at apex 56, with the surfaces 52,54 each being cut at the same angle as threads 36, e.g., 20° from the vertical, thereby forming an interior angle inside the locking sleeve of 40°. A recess 58 which is part of the thread profile 50 defines upper and lower stop surfaces 60,62 (see FIG. 5), which also are generally perpendicular to the central axis of the liner. The recess or slot 58 is thus a spiraling slot spaced uniformly between the spiraling apex 56 of threads 50.

The sleeve 12' also includes conventional right-hand wicker profile interior threads 64, and similar interior lefthand threads 66 separated by spacing 68. Each of the interior threads 64,66 has a conventional geometry for biting into the liner. The threads 64,66 may typically be spaced at four threads per inch, with the interior threads 64,66 each having a thread profile defined by intersecting surfaces each 45° from the vertical, as shown. The threads 64,66 bite into the liner section 14, and are oppositely cut in conventional fashion, i.e., right-hand and left-hand threads, so that the liner section 14 cannot unthread itself from the liner hanger assembly.

The threads 36,50 are each provided along a thread taper of, e.g., ¾" per foot of threads. This thread taper is provided to inherently cause the locking sleeve to move radially inward as the locking sleeve is threaded into the cone sleeve at the surface, and must be distinguished from the tapered surfaces of the thread profile discussed above. After the interior and exterior threads have been formed on the locking sleeves, each sleeve 12 and 12' may be split along its length with a cut approximately ½" wide as shown in FIG. 3, so that the locking sleeve will easily move radially inward as the cone sleeve and locking sleeve are subsequently threaded together.

Figure 5:
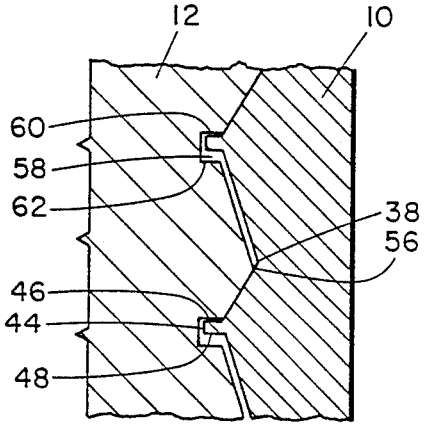
FIG. 5 is a pictorial view of a thread profile for the cone sleeve with respect to a thread profile for the locking sleeve after the liner hanger of the present invention has been subjected to an axially directed force.

Referring again to FIG. 2, the axial length of the surface 40 is slightly greater than the axial length of 42, since the length and width of the projection 40 preferably remain constant, yet the thread is tapered slightly radially outwardly as one moves axially away from body 32. Accordingly, each projection 40 is preferably uniformly sized, with a typical projection having a 0.060" axial length and a 0.013" radial width. Referring to FIG. 3, slot 58 between adjacent thread profiles may be approximately 0.125" in length and 0.020" in width, thereby allowing approximately 0.03" of axial movement in either the upward or downward direction between the locking sleeve and the cone sleeve. In order that each slot 58 may also be uniformly sized, the surface 52 is axially slightly longer than the surface 54 to accomodate the taper of the threads. Thus, the maximum movement of cone sleeve 10 relative to locking sleeve 12 is substantially less than the axial spacing of the cooperating threads, as shown in FIGS. 4 and 5.

Referring now to FIGS. 1 and 4, the liner hanger assembly may be assembled at the well site with a torque of approximately 5,000 foot pounds applied between the cone sleeve and the locking sleeve to force the right and left-hand wicker threads 64,66 into biting engagement with the liner 14. The assembly 8 may then be lowered into the well, and the mechanical or hydraulical slips 18 set into fixed engagement with the casing 20 in a conventional manner. As the assembly 8 is positioned in the well and prior to setting of the slips 18, the apexes 38,56 of the threads 36,50 will thus be substantially axially aligned, as shown in FIG. 4. In this position, the spiraling projection 44 will be generally centered in the spiraling slot or cavity 58, and will thus be out of engagement with stop surfaces 60,62.

After setting of the slips 18, a substantially axially directed downward force may be applied to the locking sleeve 12. This force, which typically may be a range from 50,000 pounds axial load to 250,000 pounds axial load, will cause the liner 14 and the locking sleeve 12 as a unit to move axially with respect to cone sleeve 10, thereby bringing the upper planar surface 46 of projection 44 closer toward engagement with upper planar surface 60. This axial movement, in turn, will force the inner threads 64,66 of the locking sleeve into deeper biting engagement with the liner 14 as the planar tapered surfaces of the thread profiles for the threads 36,50 slide with respect to each other. If this axial force were increased, the surfaces 46,60 would eventually engage to prohibit any further axial movement between the cone sleeve and the locking sleeve even if the axial directed force were thereafter increased. This feature of the invention thus limits the added radial inward biting motion of the teeth 64,66 to an extent that will not crush the liner 14 or result in fracture of the cone sleeve or locking sleeve.

The above-described substantial axially-directed force may be applied by various techniques. If the liner 14 has sufficient weight, this force may be applied simply by releasing the liner from the setting tool, so that the weight of the liner itself provides the substantial downward force on the locking sleeves 12 and 12'. A potential slippage problem between the liner and the locking sleeve frequently occurs if the assembly as shown in FIG. 1 were to become stuck as it was being retrieved from a well. During this retrieval operation, a substantial pulling force would typically be imparted to the liner 14 to free the stuck assembly. According to the present invention, this upward force would move the locking sleeve upward with respect to the cone sleeve as the upward force was increased, thus again increasing biting of the teeth 4,66 into the liner section. This increased biting movement would be limited by the engagement of the surface 48 of the cone sleeve with the surface 62 of the locking sleeve, thereby again preventing collapse of the liner 14 or fracture of the tubing anchor components.

Upon the application of the axially directed force, the locking sleeve may typically move 0.03" axially with respect to the cone sleeve, thereby causing the locking sleeve to move radially 0.01" with respect to the cone sleeve. This 0.01" radial separation will typically be shared by swell or expansion of the cone sleeve, and additional radial penetration of the locking teeth into the liner. Although only a portion of this 0.01" exemplary separation may result in radial penetration of the locking sleeve into the liner, this penetration is critical to imparting the necessary increased biting force to the liner.

Mating threads on the cone sleeve and locking sleeve may be sized so that the stop surfaces are engaged when a preselected axial force, e.g., 200,000 pounds, is applied to the liner hanger in either the upward or downward direction. This axial force will thus result in a radial biting force by the locking sleeve into the liner many times the biting force obtained by the initial 5,000 pounds makeup torque. Moreover, this increased biting force is obtained while the locking sleeve remains centered on the liner section. In other words, the axial movement of the cone sleeve with respect to the locking sleeve along the taper of the thread profiles does not cause the locking sleeve to move out of alignment with the liner.

One of the features of the present invention is that the application of the substantial axially-directed force on the liner in either the upward or downward direction results in limited or controlled axial movement between the cone sleeve and the locking sleeve. Thus, the entire threaded length of the cone sleeve and locking sleeve as made up at the surface remains available to withstand the axially-directed force, and to transmit increased biting force to the liner. This increased biting force is applied directly as a result of the axial force which otherwise would tend to cause slippage between the liner and the locking sleeve. Accordingly, the present invention provides increased biting force precisely when it is needed, i.e., when the axially-directed load which otherwise would cause slippage is increased.

It should be understood that opposing tapered surface for the mating threads of the cone sleeve and the locking sleeve define the apex of each thread profile, although those opposing tapered surfaces need not physically intersect to form such an apex. In other words, the planar tapered surfaces 40,42 would define a thread profile apex within the scope of the present invention even if the surfaces 40,42 were axially separated by a short cylindrical surface. Similarly, the tapered surfaces 52,54 need not physically meet at apex 56 to achieve the benefits of the present invention.

The planar surfaces of the thread profiles which slidably engage each other are preferably tapered at substantially the same angle, e.g., 20° relative to the axis of the liner or the liner hanger, so that there is substantially area engagement of these surfaces during axial movement of the cone sleeve relative to the locking sleeve. Also, the opposing taper of each thread profile may be identical, so that the same axially directed biting force on the liner is exerted by equal although oppositely directed axial loads on the locking sleeve. Although a taper of from 12° to 28° is considered within the preferred range, the desired angle of the taper can be altered to increase or decrease the desired radial biting force on the liner for a presumed axial load. Each of the stop surfaces 46, 48, 60 and 62 are preferably perpendicular to the axis of the liner, so that no change in the axially directed force to the liner results from an increase in axial load subsequent to the engagement of respect stop surfaces, as described above.

As a further modification of the invention, it should be understood that the stop surfaces for limiting the axial movement of the locking sleeve with respect to the cone sleeve may be provided on the locking sleeve and cone sleeve separate from the thread profiles, with the stop surfaces nevertheless effectively limiting radial biting force on the liner. The embodiment previously described is preferred, however, since the desired spacing between the stop surfaces need not be adjusted depending on the extent the cone sleeve and locking sleeve are torqued together at the surface. Moreover, the previously described embodiment ensures that the increase in axial load after the stop surfaces engage will be evenly distributed along the length of the mating thread. Also, those skilled in the art will appreciate that the projection portion of the thread profile could be provided on the locking sleeve, and a slot provided on the cone sleeve. In the latter described embodiment, the apex defined by the opposing surface on the locking sleeve would then typically form an interior angle within the locking sleeve of 220°, while the apex defined by the opposing surfaces on the cone sleeve would typically form an exterior angle outside the cone sleeve of 220°.

Finally, the concepts of the present invention may be utilized to secure any tubular to a hanger in a well bore. If the hanger were to secure a tubular larger in diameter than the hanger, the outer sleeve would be provided as a split ring, and its outer cylindrical surface would then include teeth for biting the tubular.

Although the invention has been described in terms of the specified embodiments which are set forth in detail, it should be understood that these are by illustration only, and that alternative embodiments and operating techniques will become apparent to those skilled in the art in view of the disclosure. Accordingly, further modifications are contemplated which can be made without departing from the spirit of the described invention.

What is claimed and desired to be secured by Letters Patent is:

1. An improved liner hanger for securing a liner to a well casing, the liner hanger having a central axis and including a cone sleeve having a first thread on an interior surface thereof for mated engagement with a second thread on an exterior surface of a split ring locking sleeve positionable radially between the liner and the cone sleeve, the cone sleeve being interconnected with slips for selective fixed engagement with the well casing, and the locking sleeve having an interior surface for biting engagement with the liner, the liner hanger further comprising:

the first thread on the cone sleeve being formed along a taper and having a first thread profile including a pair of oppositely tapered interior surfaces which define a first thread profile apex;

the second thread on the locking sleeve being formed along the taper of the first thread and having a second thread profile including a pair of oppositely tapered exterior surfaces which define a second thread profile apex, such that apexes of the first and second thread profiles are axially aligned when the locking sleeve and cone sleeve are threaded into torqued engagement;

said locking sleeve being axially movable with respect to said cone sleeve while in threaded engagement therewith by sliding engagement of one of the pair of tapered exterior surfaces along an adjoining one of the pair of tapered interior surfaces, such that the locking sleeve moves radially inward with respect to the cone sleeve as the apexes move out of axial alignment; and first and second stop surfaces on the cone sleeve and locking sleeve, respectively, each substantially perpendicular to the central axis of the liner hanger and selectively positioned relative to each other for limiting maximum axial downward movement of the locking sleeve with respect to the cone sleeve to less than the axial spacing of said apexes and thereby limiting maximum radial inward movement of the locking sleeve with respect to the cone sleeve.

2. The liner hanger as defined in claim 1, wherein each of the pair of interior surfaces of the first thread profile are planar surfaces which adjoin at the first threads profile apex, and each of the pair of exterior surface of the second thread profile are planar surfaces which adjoin at the second thread profile apex.

3. The liner hanger as defined in claim 2, wherein the planar surfaces of the first and second thread profiles are each tapered at an angle of from 12° to 28° with respect to the central axis of the liner hanger.

4. The liner hanger as defined in claim 3, wherein each of the planar surfaces of the first and second thread profiles are tapered at substantially the same angle with respect to the central axis of the liner hanger.

5. The liner hanger as defined in claim 1, further comprising:

third and fourth stop surfaces on the cone sleeve and locking sleeve, respectively, each substantially perpendicular to the central axis of the liner hanger and selectively positioned relative to each other for limiting maximum axial upward movement of the locking sleeve with respect to the cone sleeve to less than the axial spacing of said apex and thereby limiting maximum radially inward movement of the locking sleeve with respect to the cone sleeve.

6. The liner hanger as defined in claim 5, wherein:

the first thread profile includes the first and third stop surfaces; and the second thread profile includes the second and fourth stop surfaces, such that each of the stop surfaces is formed along the mated first and second threads.

7. The liner hanger as defined in claim 1, further comprising:

the first thread profile including a radial inwardly directed projection having said first stop surface; and the second thread profile including a radial inwardly directed slot having said second stop surface.

8. The thread profile as defined in claim 1, wherein the interior surface of the locking sleeve for biting engagement with the liner comprises:

right-hand threads for biting engagement with the liner; and left-hand threads for simultaneous biting engagement with the liner.

9. An improved hanger for securing a tubular thereto for position the tubular with a well bore, the hanger having a central axis and including a first sleeve having a first thread on an interior surface thereof for mated engagement with a second thread on an exterior surface of a second sleeve, one of the first or second sleeves being a split ring sleeve having a substantially cylindrical interior surface for biting engagement with the tubular, the hanger further comprising:

the first thread on the first sleeve having a first thread profile including a first planar tapered interior surface and a third planar tapered interior surface which define a first thread profile apex;

the second thread on the second sleeve having a second thread profile including a second planar tapered exterior surface and a fourth exterior surface which define a second planar tapered thread profile apex, such that the apexes of the first and second thread profiles are axially aligned when the first sleeve and second sleeve are threaded in torqued engagement;

said first sleeve being axially movable with respect to said second sleeve while in threaded engagement therewith by sliding engagement of the first planar tapered interior surface along the second planar tapered exterior surface, such that the first and second sleeves separate radially as the apexes move out of axial alignment to move the cylindrical surface of the slit ring sleeve into deeper biting engagement with the tubular; and first and second stop surfaces on the first and seocnd sleeves, respectively, each substantially perpendicular to the central axis of the hanger and selectively positioned relative to each other for limiting maximum axial downward movement of the first sleeve with respect to the second sleeve to less than the axial spacing of said apexes and thereby limiting maximum radial separation of the first and second sleeves.

10. The hanger as defined in claim 9, wherein:

each of the first and second threads being formed along a taper such that the second sleeve moves radially inward as the first and second sleeves are threaded into torqued engagement; and the planar surfaces of the first and second thread profiles are each tapered at substantially the same angle in the range of from 12° to 28° with respect to the central axis of the liner hanger.

11. The hanger as defined in claim 9, further comprising:

the third interior surface being oppositely tapered with respect to the first surface and adjoining the first surface;

the fourth exterior surface being oppositely tapered with respect to the second surface and adjoining the second surface; and third and fourth stop surfaces on the first and second sleeve, respectively, each substantially perpendicular to the central axis of the liner hanger and selectively positioned relative to each other for limiting maximum axial upward movement of the first sleeve with respect to the second sleeve and thereby limiting maximum radially inward separation of the first and second sleeves.

12. The hanger as defined in claim 11, wherein:

the first thread profile includes the first and third stop surfaces; and the second thread profile includes the second and fourth stop surfaces, such that each of the stop surfaces is formed along the mated first and second threads.

13. The hanger as defined in claim 12, further comprising:

the first thread profile including a radial inwardly directed projection having said first stop surface; and the second thread profile including a radial inwardly directed slot having said second stop surface.

14. An improved method of securing a tubular within a well bore with a hanger, the hanger having a central axis and including a cone sleeve having a first thread on an interior surface thereof for mated engagement with a second thread on an exterior surface of a split ring locking sleeve, the locking sleeve having an interior cylindrical surface for biting engagement with the tubular, the method comprising:

forming the first threads on the cone sleeve with a first thread profile including a pair of oppositely tapered interior surfaces which define a first thread profile apex;

forming second threads on the locking sleeve having a second thread profile including a pair of oppositely tapered exterior surface which define a second thread profile apex;

threadably interconnecting the cone sleeve and the locking sleeve so as to drive the interior cylindrical surface of the locking sleeve into biting engagement with the tubular while the thread profile apexes are substantially in axial alignment;

thereafter lowering the tubular, the locking sleeve, and the cone sleeve into the well bore;

thereafter mechanically fixing the cone sleeve at a selected location within the well bore;

thereafter applying a substantial axially-directed force to the locking sleeve to move the locking sleeve axially with respect to the cone sleeve, such that one of the pair of tapered exterior surfaces of the locking sleeve slides along an adjoining one of the pair of tapered interior surface of the cone sleeve to move the thread apexes out of axial alignment while driving the locking sleeve radially inward to increase biting engagement with the tubular; and forming first and second stop surfaces on the cone sleeve and locking sleeve, respectively, each substantially perpendicular to the central axis of the hanger and selectively positioned relative to each other for limiting maximum axial downward movement of the locking sleeve with respect to the cone sleeve to less than the axial spacing of said apexes and thereby limiting maximum radially inward movement of the locking sleeve with respect to the cone sleeve.

15. The method as defined in claim 14, wherein each of the pair of interior surfaces of the first thread profile are formed as planar surface which adjoin at the first thread profile apex, and each of the pair of exterior surfaces of the second thread profile are formed as planar surfaces which adjoin at the second thread profile apex.

16. The method as defined in claim 15, wherein the planar surfaces of the first and second thread profiles are each tapered at substantially the same angle of from 12° to 28° with respect to the central axis of the liner hanger.

17. The method as defined in claim 14, further comprising:

forming a third and fourth stop surfaces on the cone sleeve and locking sleeve, respectively, each substantially perpendicular to the central axis of the hanger and selectively positioned relative to each other for limiting maximum axial upward movement of the locking sleeve with respect to the cone sleeve to less than the axial spacing of said apexes and thereby limiting maximum radially inward movement of the locking sleeve with respect to the cone sleeve.

18. The method as defined in claim 17, further comprising:

forming the first and third stop surfaces along the first thread profile; and forming the second and fourth stop surfaces along the second thread profile, such that each of the stop surfaces is formed along the mated first and second threads.

19. The method as defined in claim 18, further comprising:

forming a radial inwardly-directed projection along the first thread profile, the projection including the first and third stop surfaces; and forming a radial inwardly-directed slot along the second thread profile, the slot defining the second and fourth stop surfaces.

* * * * *